US005511998A

United States Patent [19]

Johnson

[11] Patent Number: 5,511,998

[45] Date of Patent: Apr. 30, 1996

[54] SWIMMER TRAINING PADDLE

[76] Inventor: Ronald L. Johnson, 2538 N. 65th St., Scottsdale, Ariz. 85251

[21] Appl. No.: 502,630

[22] Filed: Jul. 14, 1995

[51] Int. Cl.[6] ..... A63B 31/10

[52] U.S. Cl. ..... 441/56; 441/58

[58] Field of Search ..... 441/55, 56, 57, 441/58, 59, 60, 61, 62, 63, 64; D21/236, 237, 238; 434/254

[56] References Cited

U.S. PATENT DOCUMENTS

| | | | |
|---|---|---|---|
| 1,621,693 | 3/1927 | Theobald | 441/58 |
| 2,017,463 | 10/1935 | Komadina | 441/58 |
| 2,109,429 | 2/1938 | Malm | 441/56 |
| 2,555,969 | 6/1951 | Holcombe | 441/58 |
| 4,913,418 | 4/1990 | Schlueter et al. | 272/71 |
| 5,147,233 | 9/1992 | Hannula | 441/56 |
| 5,288,254 | 2/1994 | Elson | 441/56 |

*Primary Examiner*—Stephen Avila
*Attorney, Agent, or Firm*—Warren F. B. Lindsley

[57] ABSTRACT

A swimmer's hand paddle in the form of a rigid planar member has a mitten-shaped surface area, larger than the human hand and wider in the palm area than in the area of the middle finger, and has an irregularly-shaped aperture of a width approaching the width of the hand positioned at a location on the paddle so as to be covered by the most sensitive area of the palm when the hand is properly positioned on the paddle. From one end of a proximal curved wrist edge to a point beyond the end of the thumb, the thumb side edge closely approaches the outer edge of the thumb and then curves inwardly and merges with a sharply curved distal end, whereas the little finger side edge extends with flared curvature from the distal end to the other end of the curved wrist edge. The area of the little finger side of the paddle is larger than the thumb side area, and has a curved row of perforations which closely approaches the little finger side edge for reducing the resistance to water of the little finger side during the routine of a swimming stroke. The user's hand is attached to and positioned on the paddle by sections of rubber tubing pulled through sets of perforations, one set positioned near the wrist edge and another set positioned at the approximate location of the base of the user's fingers.

14 Claims, 1 Drawing Sheet

10
11
12
12b
12c
12d
12e
13
14
15b
16
17
18
22
23
24
25
26
27
28
29
30
31
32
33
34
35
36
37
38
39
5
6

30
31
32
33
34
35
36
37
38
39

13
16
22
25
26
27
28
29

10
11
13
14
15
15a
15b
16
17
18
20
20a
20b
20c
22
25
26
27
28
29
30
31
32
33
34
35
36
37
38
39

11
12
26
27
29

11
12b
12c
12d
12e
30
31
34
38

SWIMMER TRAINING PADDLE

BACKGROUND OF THE INVENTION

This invention relates to training aids for swimmers and, more particularly, to training paddles such as are used to provide increased resistance to the swimmer's stroking motion for strength building exercises.

A swimmer is propelled forward by displacing water rearwardly through the motion of the hands and feet. Any individual who wishes to gain a competitive edge will have to engage in some form of regular resistance training. Sports specific training is recognized as the best method for enhancing stroke strength and endurance and using hand paddles is one way that swimmers have achieved this. Correspondingly, it is not surprising that the shoulder is the most commonly injured part of a competitive swimmer's body.

While the use of paddles increases water displacement and thereby the thrust of each swimming stroke, at the same time they increase the tendency of the swimmer's hand to rotate; the tendency is especially pronounced if the area of the paddle is large relative to the size of the hand. The swimmer must counteract this rotational tendency in order to maintain stability of the hand which, in turn, maximizes water displacement, and thus determines the efficiency of each stroke.

Known training devices include hand-sized, and larger, rectangular or oval hand paddles made of rigid plastic material provided with a finger loop and an optional wrist loop for securing the hand to the paddle. Examples include the paddle described in U.S. Pat. No. 5,147,233, which takes the form of a generally rectangular rigid, planar member having a power surface textured with channels that direct and momentarily capture water, the other surface being configured to engage a swimmer's hand. The momentary capture of water by the textured surface is said to increase the thrust achieved with each stroke.

The swimmer training paddle disclosed in U.S. Pat. No. 5,288,254 is a generally triangular, planar member having a rounded forward edge, first and second side edges and a rearward edge. A fin depends from the under surface of the planar member and means are provided for attaching a swimmer's middle finger for holding the hand palm side down against the upper surface.

The hand paddle described in U.S. Pat. No. 4,913,418 is a flat plastic sheet in the form of a rectangle whose corners have been rounded, and has a surface area significantly larger than a human hand. A plurality of apertures are arranged to cover an area on the paddle approximately equal to the user's hand size and offset toward the thumb side of the paddle. The apertures closely approach the edge of the paddle on the thumb side, leaving a substantially larger area on the little finger or foil side of the paddle. Although this swimmer's paddle has enjoyed wide acceptance, experience has shown that this and other prior art designs of generally rectangular or oval shape place excessive resistance on the biceps tendon (long head) and on the supraspinatus muscle of the rotator cuff in the early pull-through phase of the freestyle swim cycle. These forces can also lead to impingement syndrome, again contributing to excessive stress and damage over the anterior (frontal area) aspect of the shoulder.

Thus, a need exists for an improved swimmer training paddle that enhances stroke strength while minimizing the risk of shoulder injury.

Accordingly, it is a primary object of the invention to provide an improved swimming paddle that increases a swimmer's arm strength and endurance without placing excessive resistance on the biceps and shoulder of the swimmer.

Another object is to provide such improved swimming paddle that also decreases the tendency of a swimmer's hand to rotate during the routine of a stroke.

Yet another object is to provide an improved swimming paddle which enhances stroke strength without placing excessive pressure on the acromo-clavicular joint of the shoulder and the rotator cuff area, thereby to reduce the risk of injury to the shoulder.

It is another object of the invention to provide an improved swimming paddle which during the routine of a stroke directs water onto the most sensitive area of the palm of the user's hand for promoting development of improved proprioceptive feel for subtle changes in water pressure during execution of the stroke, essential to improving the swimmer's skill in the water.

BRIEF SUMMARY OF THE INVENTION

Briefly, these and other objects are achieved by a planar mitten-shaped swimmer training paddle having a surface area larger than the user's hand, on which the hand is placed palm side down. The paddle is bounded by a proximal edge curved to accommodate the user's wrist, a first curved lateral edge connecting one end of the proximal edge to one end of a sharply curved distal edge, and a second curved lateral edge connecting the other end of the distal edge to the other end of the proximal edge. From one end of the proximal edge to a point beyond the tip of the thumb, the first lateral edge closely approaches the outer edge of the thumb of a hand attached palm side down to the upper surface and then curves inwardly and merges with the curvature of the distal edge. The second lateral edge has a flared curvature throughout its length and constitutes the little finger edge of the paddle. The area of the little finger or foil side of the paddle is substantially larger than the thumb side.

The paddle has a relatively large irregularly-shaped aperture positioned generally centrally of the surface area at a location so as to be covered by the most sensitive area of the palm and fingers when the hand is in position on the paddle. Rubber tubing pulled through suitably positioned apertures secures the paddle to the user's hand at the wrist and at the fingers. As the paddle is thrust through the water, the user feels on the palm and fingers the flow of water through the large aperture, which aids in developing a proprioceptive feel for the subtle changes in water pressure that occur during the routine of a stroke, essential to improving a swimmer's skill in the water. A plurality of circular perforations arranged in a curved row which closely approaches and follows the curvature of the little finger side edge reduces the pressure of the water on the little finger side; this coupled with the relatively smaller surface area of the thumb side reduces pressure on the acromo-clavicular joint of the shoulder and the biceps tendon. These features, in conjunction with the angle at which the hand is attached, reduces the tendency of the paddle to rotate toward the thumb side during the routine of the stroke.

BRIEF DESCRIPTION OF THE DRAWINGS

Other objects, features and advantages of the invention will become apparent, and its construction and operation better understood, from the following detailed description read in conjunction with the accompanying drawings, in which.

DETAILED DESCRIPTION OF THE PREFERRED EMBODIMENT

Figure 1:
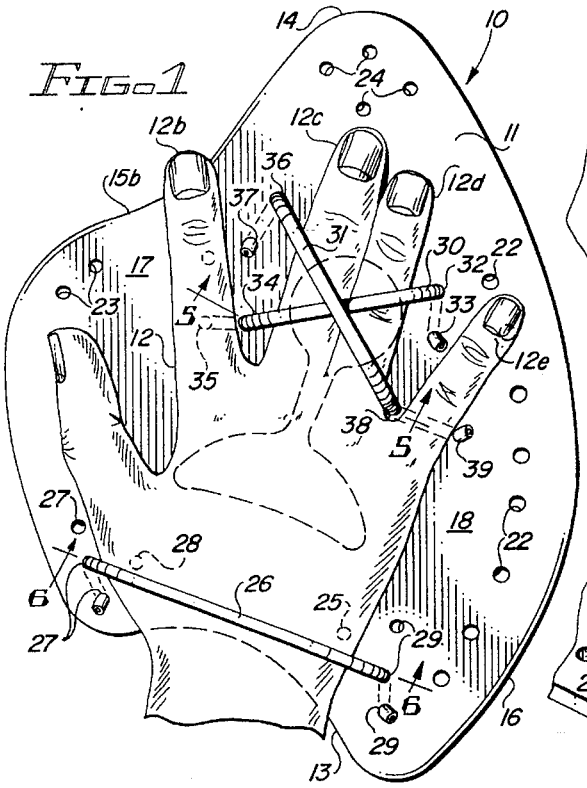
FIG. 1 is a plan view of one paddle of a set of two (second not shown), in this case a paddle for the right hand, with a user's hand attached.

A paddle 10 in accordance with a presently preferred embodiment of the invention is constructed from a relatively rigid plastic material, preferably polypropylene, injection molded to form a very smooth shape with no sharp edges which, in a thickness of about 2 mm to 4 mm has the desired degree of flexibility.

The paddle 10 is in the form of a planar member 11 having a mitten-shaped upper surface area larger than the hand 12 of a user. The planar member is bounded by a proximal edge 13, which is curved to accommodate the wrist of the user; a sharply curved distal edge 14; a first curved lateral edge 15 connecting one end of curved edge 14 and one end of proximal edge 13; and a second curved lateral edge 16 connecting the other end of curved distal edge 14 and the other end of proximal edge 13. From said one end of proximal edge 13 to a point beyond the tip of the thumb 12*a*, a portion 15*a* of lateral edge 15 closely approaches the outer edge of the thumb of a user's hand 12 attached palm side down to the upper surface, and then curves inwardly at 15*b* and merges with sharply curved distal edge 14 and defines a thumb side 17 of the upper surface. Lateral edge 16 has a flaring curvature and constitutes the edge of a little finger or foil side 18 of the upper surface, the surface area of which is larger than thumb side 17.

In one embodiment, the length of the paddle, measured from distal edge 15 to the point where lateral edge 16 joins proximal edge 13, is about eleven inches and its width at its widest point is about eight and one-half inches.

The paddle has a relatively large irregularly-shaped aperture 20 positioned generally centrally of its surface area at a location so as to be covered by the palm and fingers of a hand properly positioned on the paddle, these areas being the most sensitive to subtle changes in water pressure that occur during the routine of a stroke. Aperture 20 has the general shape of a key hole defined by a circular opening 20*a*, typically having a diameter of 1⅝ inches, interconnected with a crescent-shaped opening 20*b*, typically 2⅞ inches wide at its widest point and 1¼ inches high, by a rectangular opening 20*c*, typically one inch long and ⅜-inch wide, giving an overall length of about four inches. The crescent shaped opening 20*b* is covered by the center of the palm of a hand 12 of average size, the ring and middle finger overlie the circular opening 20*a*, and the interconnecting opening 20*c* is covered by the area at which the palm and the base of the middle and ring fingers join.

The paddle has a plurality of perforations 22, typically ¼ inch in diameter and eight in number, arrayed in a curved row which starts near proximal edge 13, closely approaches and follows the flared curvature of lateral edge 16 and terminates opposite the distal edge of the circular opening 20*a*. Additionally, the paddle has two perforations 23 located at a point near lateral edge 15 where its curvature reverses, and a quad of perforations 24 positioned near the sharply curved distal end of the paddle. Perforations 23 are positioned to lie just off the tip of the thumb 12*a*, and perforations 24 are positioned to lie just beyond the tip of the middle finger 12*c*. Perforations 22 and 23 are of the same size, typically 1/36-inch in diameter.

Figure 4:
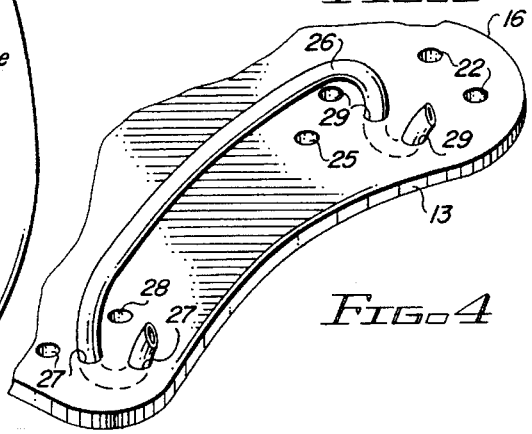
FIG. 4 is a fragmentary perspective view of the proximal edge portion of the paddle of FIG. 2.
Figure 2:
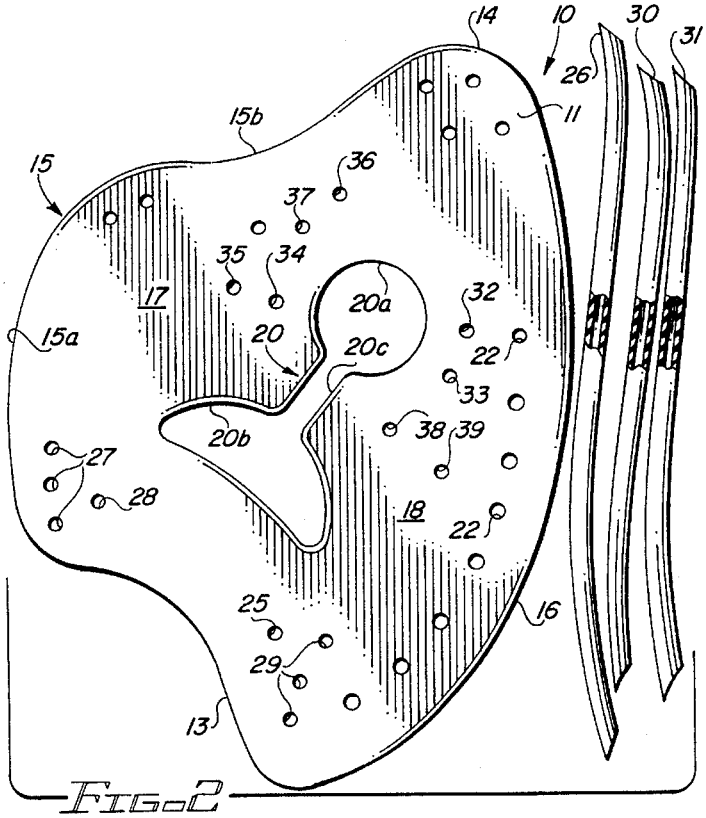
FIG. 2 is a plan view of the paddle and pieces of rubber tubing for securing the hand to the paddle.
Figure 6:
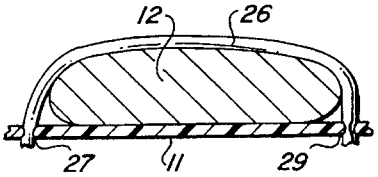
FIG. 6 is a cross-section of the paddle of FIG. 1, taken along line 6—6.
Figure 5:
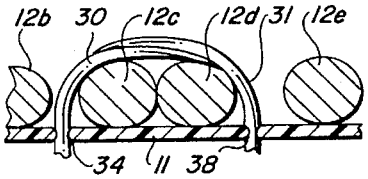
FIG. 5 is a cross-section of a fragment of the paddle of FIG. 1, taken along line 5—5.

The hand is secured to the paddle in known manner by pulling rubber tubing through appropriately located apertures at the wrist and also at the base of the fingers. In particular, as seen in FIGS. 1 and 4, the wrist is secured to the paddle with a first piece of rubber tubing 26, one end of which is pulled downwardly through a selected one of three apertures 27 generally aligned with and closely approaching the thumb side edge 15*a*, along the underside of the paddle and then upwardly through an aperture 28. The other end of tubing 26 is pulled down through a selected one of three apertures 29 located in the area of the paddle at which proximal edge 13 and lateral edge 16 are joined, and then back up through an aperture 25. The position of the user's wrist on the paddle may be adjusted, as desired, by selection of the apertures to be engaged by tubing 26.

Figure 3:
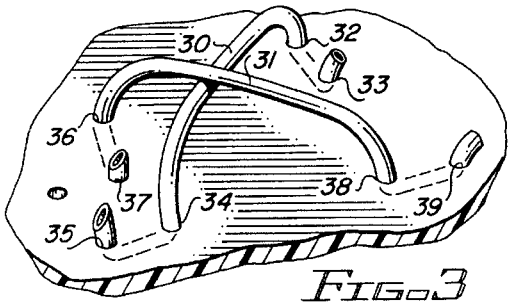
FIG. 3 is a fragmentary perspective view of a central portion of the paddle of FIG. 2.

As seen in FIGS. 1 and 3, the middle finger 12C and the ring finger 12*d* are held together and in contact with the upper surface of paddle 11 by two crossed lengths of tubing 30 and 31, each pulled through a respective pair selected from a plurality of apertures arrayed on opposite sides of circular opening 20*a*. More particularly, one end of tubing piece 30 is pulled downwardly through an aperture 32, along the underside of the paddle and then back up through an aperture 33, and the other end is pulled down through an aperture 34 and then back up through an aperture 35. In like fashion, one end of tubing section 31 is pulled down through an aperture 36 and then back up through an aperture 37, and the other end, after crossing over tubing section 30, is pulled down through an aperture 38 and then back up through an aperture 39. Paired apertures 32 and 38 located on one side of opening 20 are spaced from paired apertures 34 and 36 located at the opposite side by a distance sufficient to comfortably receive middle and ring fingers of average size therebetween. Both of the crossed pieces of tubing can be adjusted to a length at which the fingers are held together and in firm contact with the upper surface of the paddle, and are so oriented with respect to wrist strap 26 that middle finger 12*c* points toward distal edge 14 with its tip substantially centered on the quad of perforations 24.

To use, the swimmer slips the hand 12, palm side down, under and through the wrist tubing section 26 and then inserts the middle and ring fingers under the crossed tubing section 30 and 31 until the straps seat substantially at the base of the fingers; the tubing sections are then pulled further through their respective apertures to adjust the wrist and finger straps until the hand is in firm contact with the upper surface of the paddle. The location at which the middle and ring fingers are secured essentially centers the hand on the surface area of the paddle with the thumb 12*a* naturally splayed to point toward perforations 23, with the index finger 12*b* splayed to point toward curved edge portion 15*a*, and with the little finger 12*e* splayed to point toward lateral edge 17 of the paddle. The spread-out hand, which is smaller than but approaches the size of the paddle, and also similar in shape except for the foil shape of the little finger side, helps stabilize the paddle against rotation toward the thumb side which occurs with virtually all commercially available paddles, and the foil shape gives a lift force, while practicing, similar to that created by the hand alone.

In practicing a swimming stroke, such as the free-style, or crawl, for which the present paddle is best suited, the swimmer first extends the arm forward, being careful to raise the elbow and to cant the hand so the thumb is slightly downward. The hand and attached paddle are driven forward as they enter the water. The rounded distal edge 14 and the mitten shape of the paddle act separately, and cooperatively, to slice the surface of the water with minimal turbulence. While piercing the surface of the water, the hand and paddle are rotated into parallel relationship with the surface and continue to be driven rearward so that a planing motion of the body is achieved. This placing motion should continue for some distance beyond the limited reach of a single arm stroke, this being possible, partly due to the residual forward motion of the swimmer's body from previous strokes. While this motion is being executed, the paddle should continue to be maintained nearly parallel with the surface of the water to achieve optimum lift.

As the arm and hand, with the paddle attached, are driven downward and backward through the stroke, the angle at which the hand is attached on the paddle by crossed finger straps 30 and 31, will reduce the tendency of the paddle to rotate toward the thumb side, which normally occurs with the paddle design taught in the aforementioned U. S. Pat. No. 4,913,418, causing stroke faults. If toward the end of the arc of the stroke, the swimmer is not driving the hand and paddle backward and somewhat upwardly against the water until they fully meet the surface, the forward motion of the swimmer will force water between the hand and paddle as they lag, tending to peel the paddle away from the hand. Thus, the roll, pitch and yaw of the paddle must be controlled throughout the entire stroke for it to work smoothly. If turbulence or wobble is experienced, or the paddle tends to pull away from the hand, the paddle communicates to the swimmer the inefficiency of the stroke. The inventive paddle enhances such communication by the significant flow of water through the large aperture 20 impinging upon the palm and finger when the paddle is driven through the water during the routine of a stroke. That is to say, the impingement on the sensitive palm area of the considerable water flow through the shaped aperture enhances development of a proprioceptive feel for subtle changes in water pressure that occur during the stroke and enables the swimmer to correct the attitude of the paddle to make it work most efficiently and teaches the proper corresponding position for a swimmer's bare hand when not using the paddle.

Limiting the surface area of the paddle in between the thumb and index finger is expected to limit significantly damage to the biceps tendon and supraspinatus. Maximal strengthening of the rotator cuff and scapular stabilizing musculature can result due to the greater surface area at the outer (lateral) aspect of the hand. The greater lift forces that would otherwise occur because of the flared outer edge of the foil-shaped little finger side, are counterbalanced and attenuated by the flow-through apertures 22 distributed along this edge.

The foregoing detailed disclosure of the improved swimmer's hand paddle is to be considered as only illustrative of the preferred embodiment of, and not a limitation upon the scope of, the invention. Those skilled in the art will envision many other possible variations of the disclosed structure that nevertheless fall within the scope of the appended claims. For example, opening 20 may be shaped differently for optimum efficiency of use, bearing in mind that its area should approximate the area of, and be positioned on the paddle to be covered by, the most sensitive area of the user's palm to provide a feel for subtle changes in pressure of the water flowing through the opening and impinging upon the palm. Also, the number, size and locations of perforations 22, 23, 24 may be varied to the conditions of use. Further, although it is preferable to attach two fingers to the paddle in the manner shown, the finger straps may be changed to receive three or four fingers. To accommodate varying hand sizes, the paddle may be produced in a range of sizes and of other materials. Accordingly, the scope of the invention should be determined with reference to the appended claims and not by the examples which have been disclosed herein.

What is claimed is:

1. A paddle for use by a swimmer in a body of water, comprising:

a planar member having a mitten-shaped surface area wider than a human hand having a proximal wrist edge and first and second lateral edges respectively defining, by the orientation of a user's hand palm side down on said surface area, a thumb side of said area and a little finger side of said area, said planar member having an irregularly-shaped aperture positioned substantially centrally of said surface area, a first portion of the area of said aperture being crescent-shaped and having a width approaching the width of the user's hand and being interconnected with a second area portion of circular shape located to be positioned under a finger of a user's hand attached to said planar member; and means for attaching the user's hand to said planar member palm side down and for positioning the most sensitive area of the palm over said first portion of the area of said aperture whereby the user's palm feels the flow of water through said aperture.

2. The paddle of claim 1 wherein:

said planar member is formed of polypropylene and has a thickness of about 2 mm to 4 mm.

3. The paddle of claim 1 wherein:

said planar member has a plurality of perforations arrayed along a line closely parallel to said second lateral edge for reducing the resistance of said little finger area to water during the routine of a swimming stroke.

4. The paddle of claim 1 wherein:

said first lateral edge is curved and extends from a first end of said proximal edge and merges with a sharply curved distal edge; and said second lateral edge extends with outwardly flared curvature from said distal edge to a second end of said proximal edge and provides a foil area in said little finger side.

5. The paddle of claim 4 wherein said first lateral edge comprises a first portion which extends from said first end of said distal edge to a point beyond the tip of the user's thumb; and a second portion which curves inwardly from said point and extends toward and merges with said sharply curved distal edge.

6. The paddle of claim 1 wherein:

said means for releasably attaching the user's hand to said planar member comprises first strap means positioned proximate to said proximal edge for engaging the user's wrist; and second strap means positioned on said surface area at a location to engage at least the user's two middle fingers at the base thereof and pointing it toward said sharply curved distal edge.

7. The paddle of claim 6 wherein:

said second strap means comprises first and second crossed-over straps adjustably secured to said planar member by respective perforations formed in said planar member for engaging the user's middle and ring fingers at the base thereof and holding them together and in contact with said surface area.

8. The paddle of claim 4 wherein:

said planar member is formed of polypropylene and is about eleven inches long, measured from said distal end to the juncture of said second lateral edge with said proximal edge, and about eight inches wide at the widest point between said first and second lateral edges, and wherein said aperture has an overall length of about four inches and its said first portion has a width of about three inches.

9. A swimmer's hand paddle comprising:

a planar member having a mitten-shaped surface wider than a human hand, said surface having a proximal edge curved to accommodate a user's wrist and first and second lateral edges respectively defining, by the orientation of the user's hand palm side down on said surface area, a thumb side of said surface area and a little finger side of said surface area larger than said thumb side, a first portion of said first lateral edge extending from a first end of said proximal edge to a point beyond the tip of the user's thumb and a second portion curving inwardly from said point and extending toward and merging with a first end of a sharp curve which defines a distal edge, said second lateral edge having a flared curvature and extending from a second end of said sharp curve to a second end of said proximal edge and providing a foil area in said little finger side, said planar member having an irregularly-shaped aperture positioned generally centrally on said surface area, wherein a first portion of the area of said aperture is crescent-shaped and has a width approaching the width of the user's hand, and a second portion of circular shape interconnected with said first portion by a third rectangular-shaped portion; and means for releasably attaching a user's hand palm side down on said surface area of said planar member and positioning the most sensitive area of the user's palm over said first portion of the area of said aperture for enabling the palm to feel the flow of water through said aperture and to sense subtle changes in water pressure that occur during the routine of a stroke of the hand and attached planar member through the water.

10. The paddle of claim 9 wherein said planar member has a plurality of perforations arrayed along a curved line closely parallel to said second lateral edge for reducing the resistance to water of said foil area during the routine of a swimming stroke.

11. The paddle of claim 10 wherein said planar member is formed of polypropylene and has a thickness of about 2 mm to 4 mm.

12. A paddle for use by a swimmer in a body of water comprising:

a planar member having a mitten-shaped surface area wider than a user's hand having a proximal wrist edge and first and second lateral edges respectively defining, by the orientation of a user's hand palm side down on said surface area, a thumb side of said area and a little finger side of said area, wherein said first lateral edge is curved and extends from a first end of said proximal edge and merges with a sharply curved distal edge, and said second lateral edge extends with outwardly flared curvature from said sharply curved distal edge to a second end of said proximal edge, said planar member having an irregularly-shaped aperture positioned substantially centrally of said surface area, a first portion of the area of said aperture having a width approaching the width of the user's hand and being located to be positioned under the palm of a user's hand attached to said planar member and interconnected with a second area portion located to be positioned under a finger of a user's hand attached to said planar member; and means for releasably attaching the user's hand to said planar member palm side down and for positioning the most sensitive area of the palm over said first portion of said aperture for enabling the palm to sense subtle changes in pressure of water flowing through said aperture during the routine of a stroke of the hand and planar member through the water.

13. The paddle of claim 12 wherein:

said planar member has a plurality of perforations arrayed along a line in closely parallel relationship with said second lateral edge for reducing the resistance of said little finger area to water during the routine of a swimming stroke.

14. The paddle of claim 13 wherein:

said means for releasably attaching the user's hand to said planar member comprises first strap means secured to said planar member proximate to said wrist edge for engaging the user's wrist, and first and second crossed-over straps adjustably secured to said planar member at a location to engage two of the user's fingers at the base thereof and holding them together and in contact with said surface area.

* * * * *